US011217924B2

(12) United States Patent
Kobayashi

(10) Patent No.: US 11,217,924 B2
(45) Date of Patent: Jan. 4, 2022

(54) FLOATING ELECTRICAL CONNECTOR WITH CONTACTS EMBEDDED IN THE FLOATING PORTION AND METHOD FOR MANUFACTURING SAME

(71) Applicant: HIROSE ELECTRIC CO., LTD., Kanagawa (JP)

(72) Inventor: Yuki Kobayashi, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 0 days.

(21) Appl. No.: 17/063,764

(22) Filed: Oct. 6, 2020

(65) Prior Publication Data

US 2021/0111504 A1 Apr. 15, 2021

(30) Foreign Application Priority Data

Oct. 10, 2019 (JP) ..... JP2019-186755

(51) Int. Cl.

| | |
|---|---|
| ***H01R 12/91*** | (2011.01) |
| ***H01R 43/24*** | (2006.01) |
| ***H01R 12/71*** | (2011.01) |
| ***H01R 13/24*** | (2006.01) |
| *H01R 12/52* | (2011.01) |
| *H01R 12/73* | (2011.01) |
| *H01R 43/16* | (2006.01) |
| *H01R 13/504* | (2006.01) |
| *H01R 13/02* | (2006.01) |
| *H01R 13/631* | (2006.01) |
| *H01R 13/405* | (2006.01) |

(52) U.S. Cl.

CPC ..... *H01R 12/91* (2013.01); *H01R 12/716* (2013.01); *H01R 13/2407* (2013.01); *H01R 43/24* (2013.01); *H01R 12/52* (2013.01); *H01R 12/73* (2013.01); *H01R 13/02* (2013.01); *H01R 13/405* (2013.01); *H01R 13/504* (2013.01); *H01R 13/6315* (2013.01); *H01R 43/16* (2013.01)

(58) Field of Classification Search

CPC ..... H01R 12/91; H01R 43/24; H01R 12/716; H01R 13/2407; H01R 12/52; H01R 12/73; H01R 13/405; H01R 13/504; H01R 13/02; H01R 13/6315; H01R 43/16

See application file for complete search history.

(56) References Cited

U.S. PATENT DOCUMENTS

| | | | | |
|---|---|---|---|---|
| 10,290,975 | B2 * | 5/2019 | Takane | H01R 12/716 |
| 2018/0198234 | A1 | 7/2018 | Takane | |

FOREIGN PATENT DOCUMENTS

| | | | |
|---|---|---|---|
| JP | 2018-113163 | A | 7/2018 |

* cited by examiner

*Primary Examiner* — Abdullah A Riyami
*Assistant Examiner* — Justin M Kratt
(74) *Attorney, Agent, or Firm* — Rankin, Hill & Clark LLP

(57) ABSTRACT

A movable housing has a fitting recess into which a fitting protrusion of a mating connector is fitted. The fitting recess has a pair of side wall portions facing each other, a pair of connecting wall portions connecting both end portions of the pair of side wall portions, and a bottom wall portion connecting the pair of side wall portions and the pair of connecting wall portions. A plurality of terminals is held by the pair of side wall portions and the bottom wall portion. A second fixing portion of the terminal has a first and second linear shaped portion, and a first bent portion connecting the first second linear shaped portions. At least a part of the first linear shaped portion is exposed from the movable housing on an inner wall surface of the bottom wall portion.

9 Claims, 8 Drawing Sheets

FLOATING ELECTRICAL CONNECTOR WITH CONTACTS EMBEDDED IN THE FLOATING PORTION AND METHOD FOR MANUFACTURING SAME

CROSS-REFERENCE TO RELATED APPLICATION

This application claims priority from Japanese Patent Application No. 2019-186755 filed with the Japan Patent Office on Oct. 10, 2019, the entire content of which is hereby incorporated by reference.

BACKGROUND

1. Technical Field

One aspect of the present disclosure relates to an electrical connector and a method for manufacturing the electrical connector.

2. Related Art

In a circuit board electrical connector, misalignment (error) of a circuit board or a case may occur during assembly and mounting of an electronic device. It would be convenient to have a connector that can absorb such an error. As the circuit board electrical connector, a so-called floating connector is known in which a mating connector connected to the electrical connector is movable with respect to the electrical connector. Such a floating connector has a fixed housing and a movable housing. The fixed housing holds one end of a terminal, and is fixed to the circuit board by the terminal being soldered to the circuit board. The movable housing is separate from the fixed housing and movable with respect to the fixed housing. The movable housing holds the other end of the terminal that is in contact with the mating connector. The terminal has an elastic portion that is not supported at all between two held portions that are held by the fixed housing and the movable housing. The elastic portion elastically deforms, so that the movable housing is movable with respect to the fixed housing. In this way, so-called floating is achieved.

As a technique relating to such a floating connector, for example, a technique described in JP-A-2018-113163 can be cited.

SUMMARY

An electrical connector includes: a fixed housing; a movable housing displaceable with respect to the fixed housing; and a plurality of terminals held by the fixed housing and the movable housing. The terminal has a board connecting portion connected to a circuit board, a first fixing portion held by the fixed housing, a second fixing portion held by the movable housing, and an elastic portion between the first fixing portion and the second fixing portion, the movable housing has a fitting recess into which a fitting protrusion of a mating connector is fitted, the fitting recess has a pair of side wall portions facing each other, a pair of connecting wall portions connecting both end portions of the pair of side wall portions, and a bottom wall portion connecting the pair of side wall portions and the pair of connecting wall portions, the plurality of terminals is held by the pair of side wall portions and the bottom wall portion, the second fixing portion of the terminal has a first linear shaped portion extending along an inner surface of the bottom wall portion, a second linear shaped portion extending along an inner side surface of the side wall portion, and a first bent portion connecting the first linear shaped portion and the second linear shaped portion, and at least a part of the first linear shaped portion is exposed from the movable housing on an inner wall surface of the bottom wall portion.

DETAILED DESCRIPTION

Figure 1:
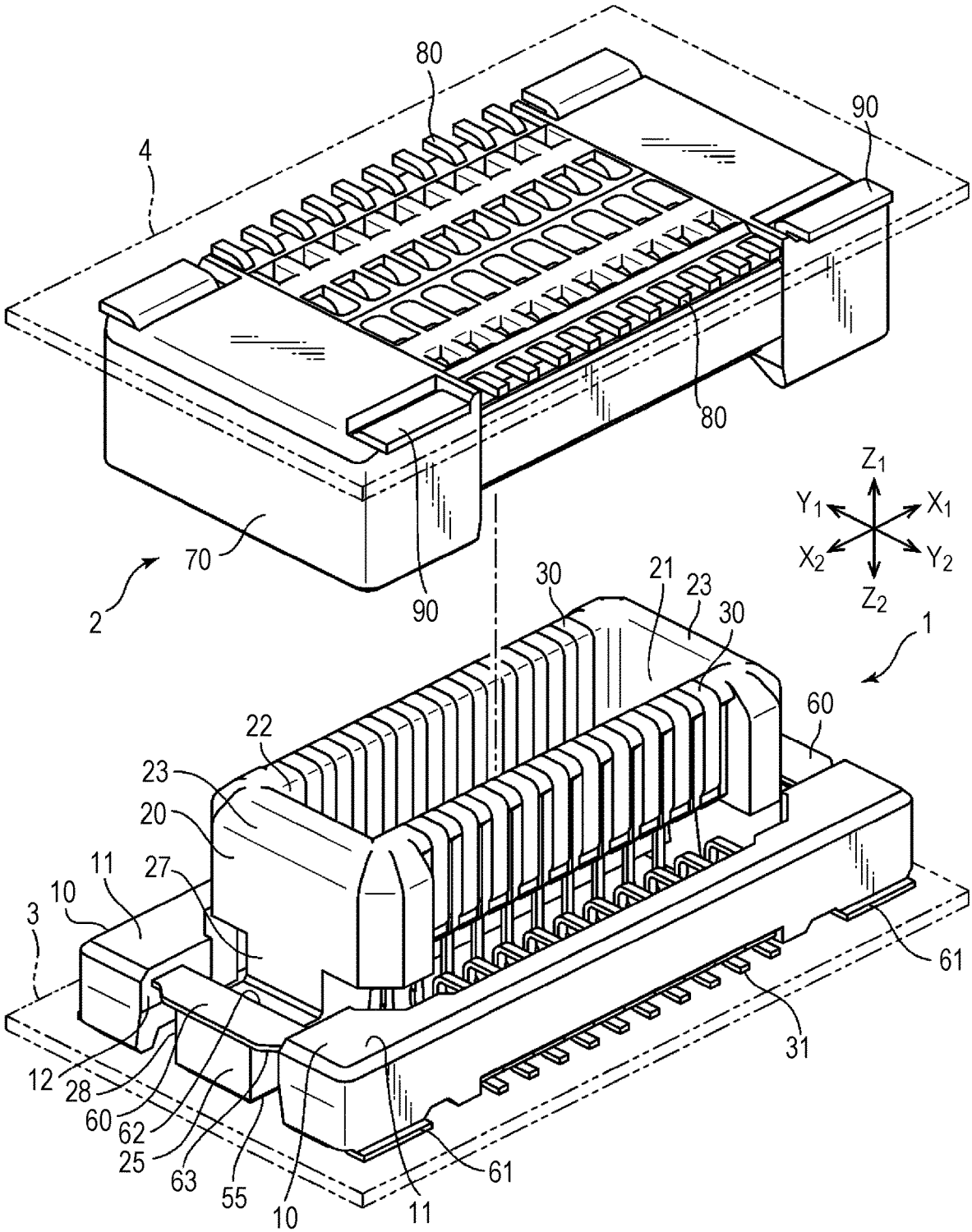
FIG. 1 is a perspective view illustrating a structure of an electrical connector and a mating connector according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

As a method for manufacturing the above-described electrical connector, a method of integrally molding a housing and a terminal can be considered. If the electrical connector having a plurality of terminals is manufactured by integral molding, positions of the terminals may be shifted during a molding process, and positional accuracy of the terminals may not be maintained. This is remarkable in the electrical connector having an elastic portion at its terminal such as a floating connector.

Therefore, an objective of the present disclosure is to provide a technique that can improve the positional accuracy of the terminal when the electrical connector is manufactured by integral molding.

The above and other objects and novel features of the present disclosure will be apparent from a description of this specification and the accompanying drawings.

An outline of a typical example among examples disclosed in the present application will be briefly described as follows.

That is, an electrical connector according to a typical example includes: a fixed housing; a movable housing displaceable with respect to the fixed housing; and a plurality of terminals held by the fixed housing and the movable housing. The terminal has a board connecting portion connected to a circuit board, a first fixing portion held by the fixed housing, a second fixing portion held by the movable housing, and an elastic portion between the first fixing portion and the second fixing portion, the movable housing has a fitting recess into which a fitting protrusion of a mating connector is fitted, the fitting recess has a pair of side wall portions facing each other, a pair of connecting wall portions connecting both end portions of the pair of side wall portions, and a bottom wall portion connecting the pair of side wall portions and the pair of connecting wall portions, the plurality of terminals is held by the pair of side wall portions and the bottom wall portion, the second fixing portion of the terminal has a first linear shaped portion extending along an inner surface of the bottom wall portion, a second linear shaped portion extending along an inner side surface of the side wall portion, and a first bent portion connecting the first linear shaped portion and the second linear shaped portion, and at least a part of the first linear shaped portion is exposed from the movable housing on an inner wall surface of the bottom wall portion.

The method according to the typical example is a method for manufacturing the electrical connector, and includes a step of integrally molding the fixed housing, the movable housing, and the terminal in a state where at least a part of the first linear shaped portion of the terminal is in contact with a mold.

An effect obtained by the typical example among the examples disclosed in the present application will be briefly described as follows.

The positional accuracy of the terminals can be improved when the electrical connector is manufactured by integral molding.

Hereinafter, embodiments of the present disclosure will be described in detail with reference to the drawings. In all the drawings for explaining the embodiments, the same members are denoted by the same reference numerals in principle and their repeated description will be omitted.

In the following embodiments, a plurality of divided sections or embodiments will be described when there is a need for convenience. Unless explicitly stated, they are not unrelated. That is, one is a modification, details, supplementary explanation, or the like of some or all of the other. Further, in the following embodiments, for example, unless a specific number is mentioned as the number of elements or the like (including the number, numerical value, amount, range, and the like), unless it is explicitly stated, or unless it is clearly limited to a specific number in principle, the number of elements and the like are not limited to the specific number, and may be more or less than the specific number.

In the following embodiments, for convenience of description, a longitudinal direction (terminal arrangement direction) of the electrical connector is the X ($X_1$, $X_2$) direction, and a short direction (terminal facing direction) is the Y ($Y_1$, $Y_2$) direction, and a height direction (fitting/removing direction) is the Z ($Z_1$, $Z_2$) direction. The directions are for explaining a relative positional relationship of sections constituting the connector, and do not indicate absolute directions.

Figure 2:
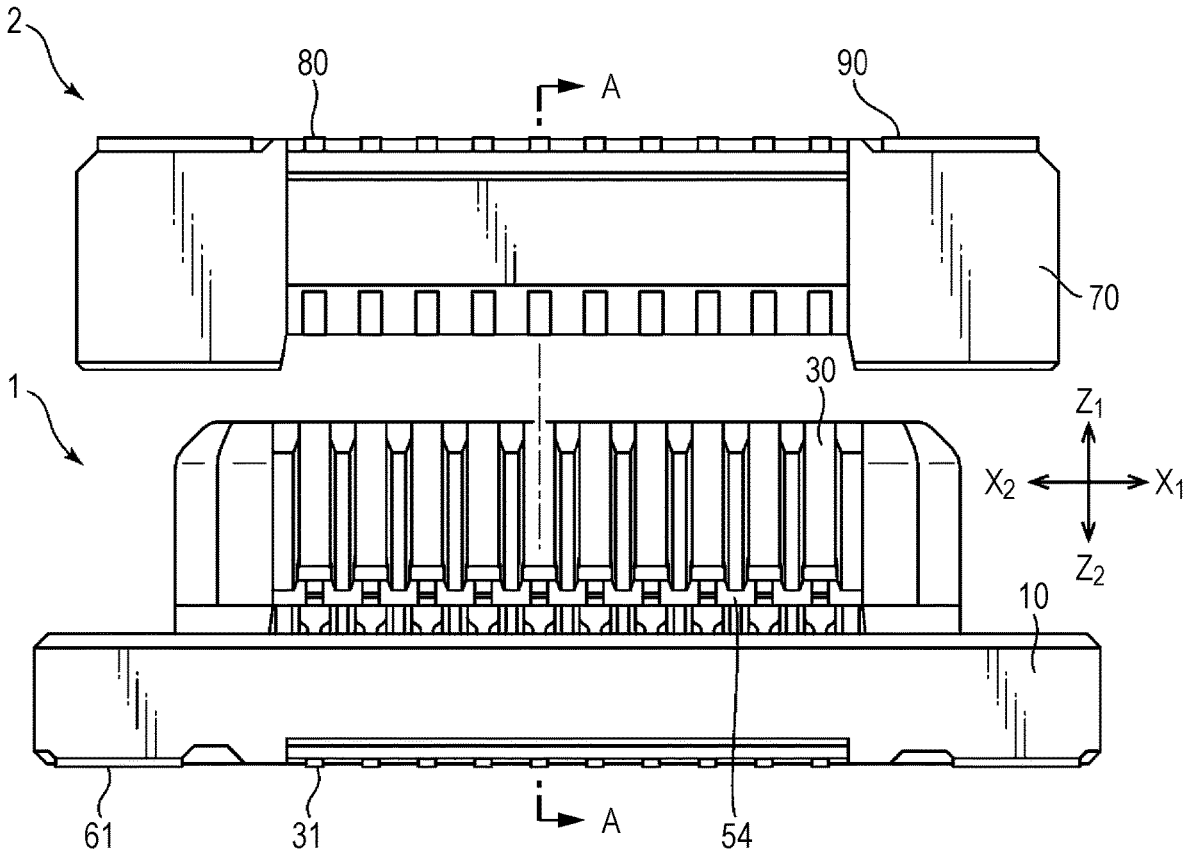
FIG. 2 is a front view illustrating the structure of the electrical connector and the mating connector according to the embodiment of the present disclosure.
Figure 3:
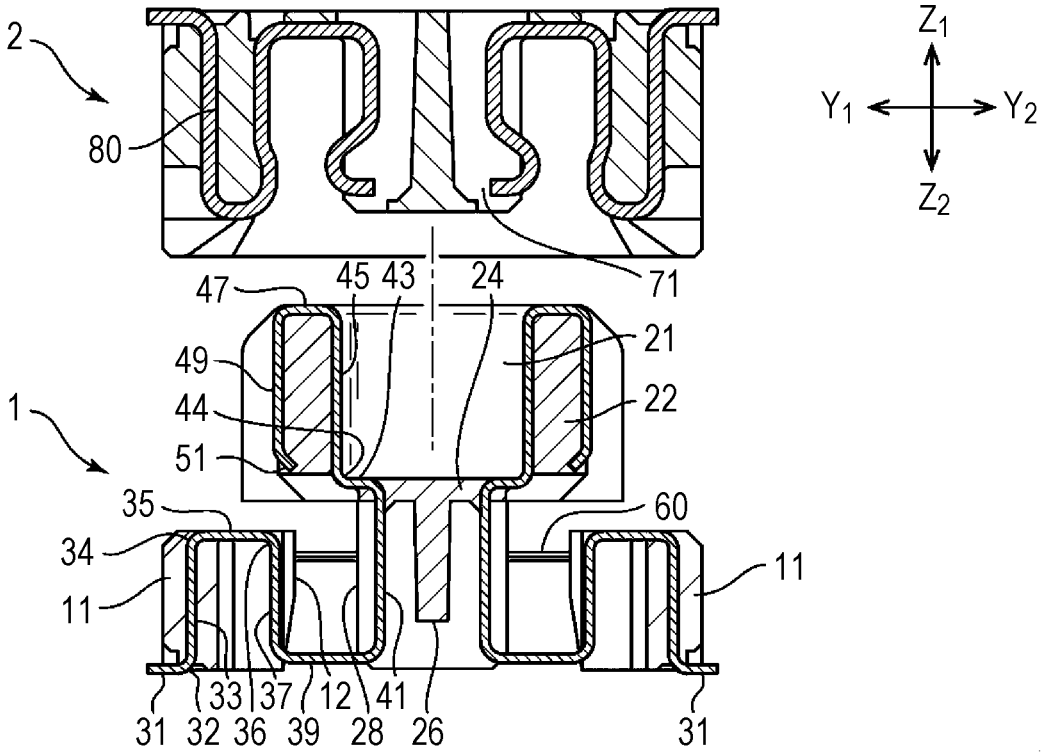
FIG. 3 is a cross-sectional view taken along a line A-A of FIG. 2.
Figure 4:
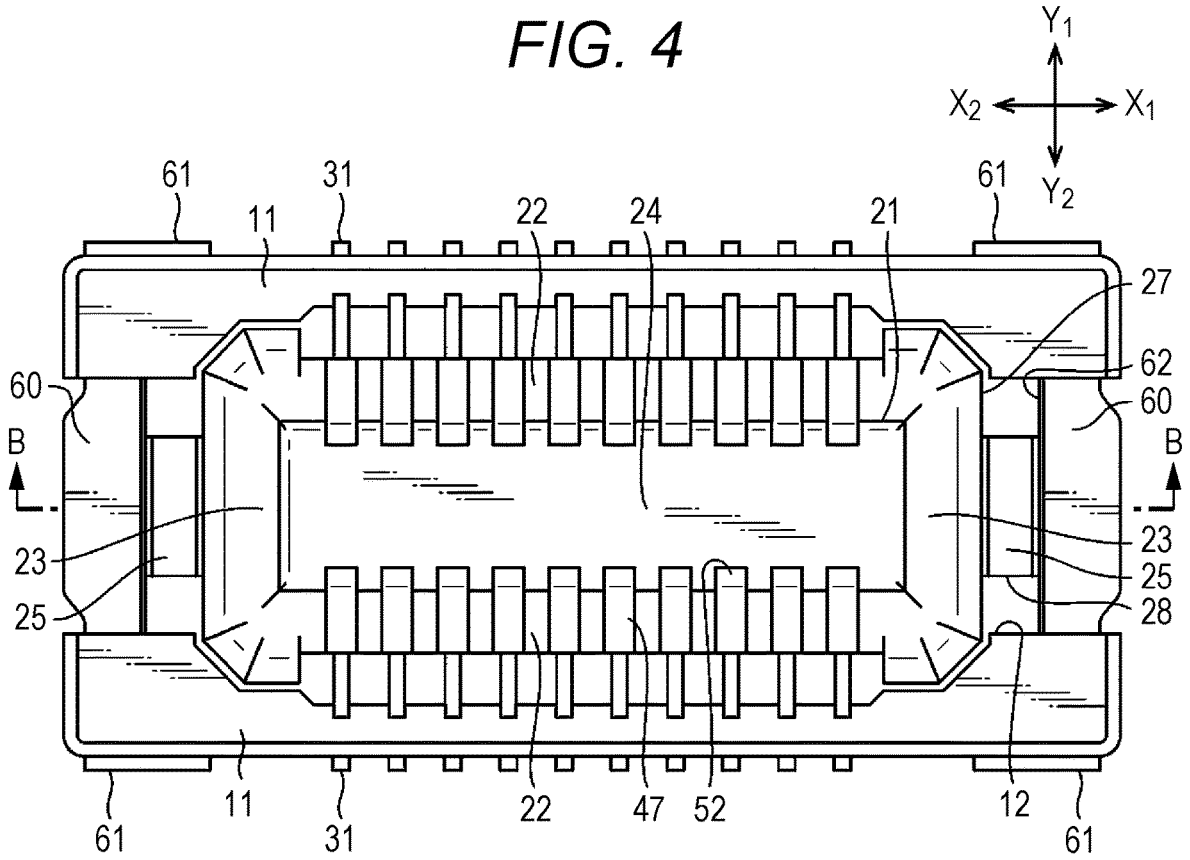
FIG. 4 is a plan view illustrating the structure of the electrical connector according to the embodiment of the present disclosure.
Figure 5:
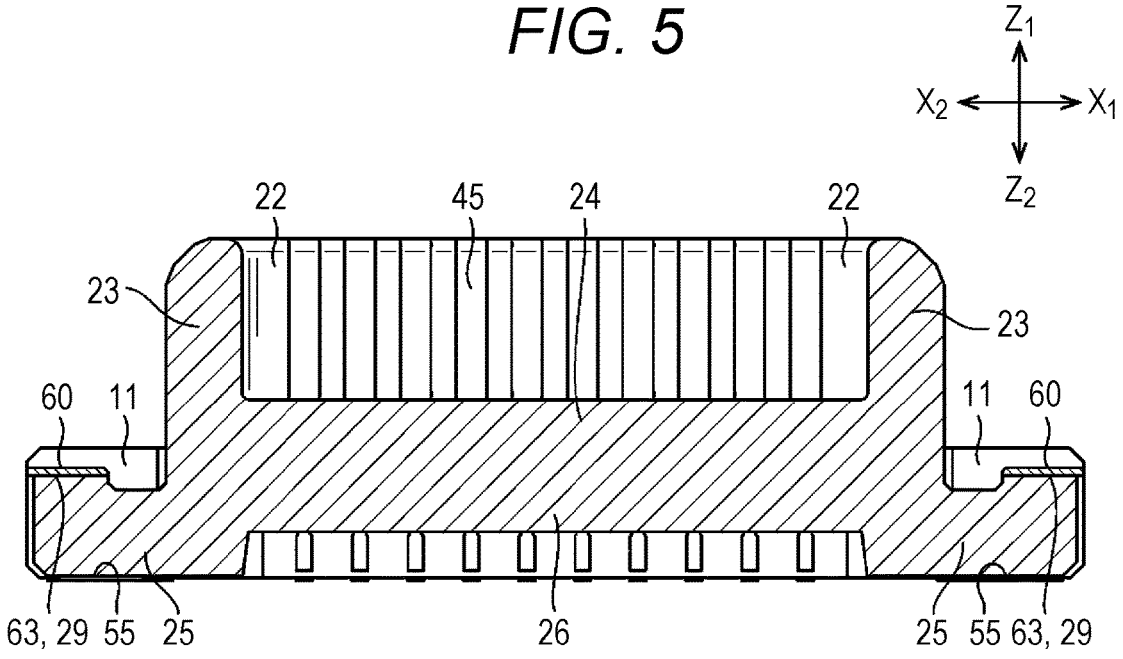
FIG. 5 is a cross-sectional view taken along a line B-B of FIG. 4.
Figure 6:
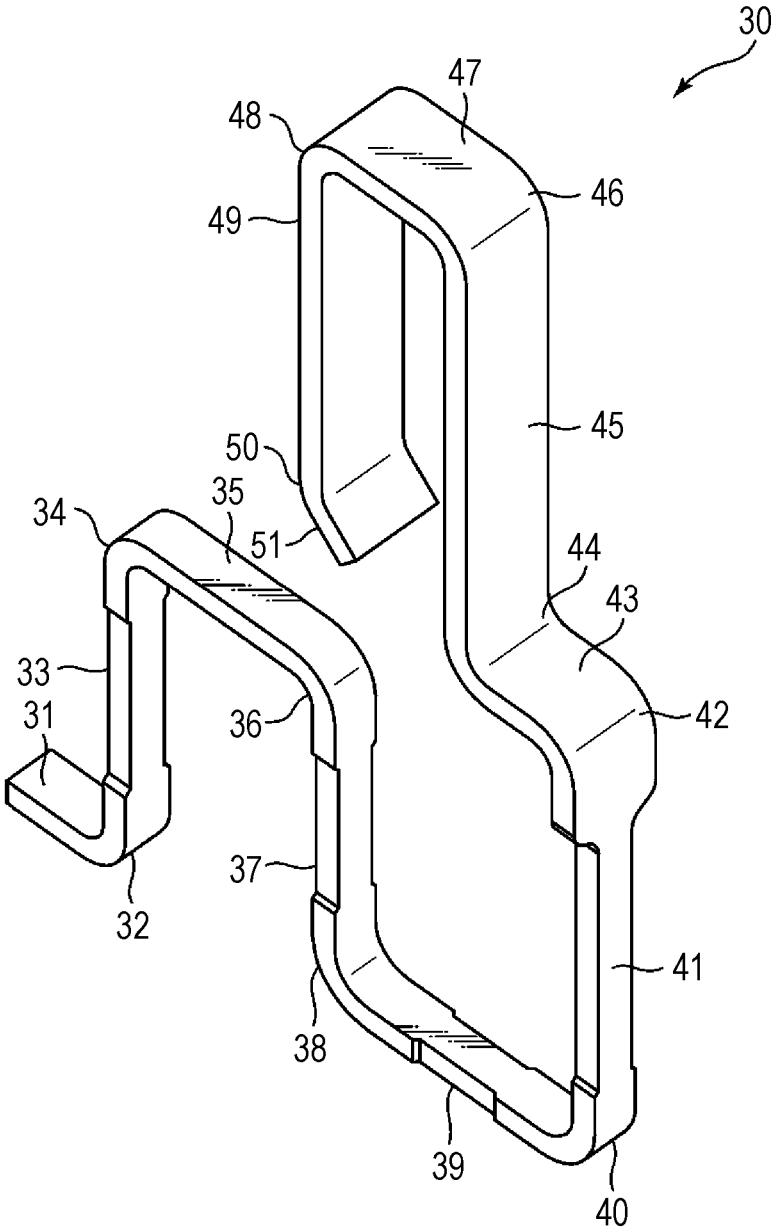
FIG. 6 is a perspective view illustrating a structure of a terminal of the electrical connector according to the embodiment of the present disclosure.
Figure 7:
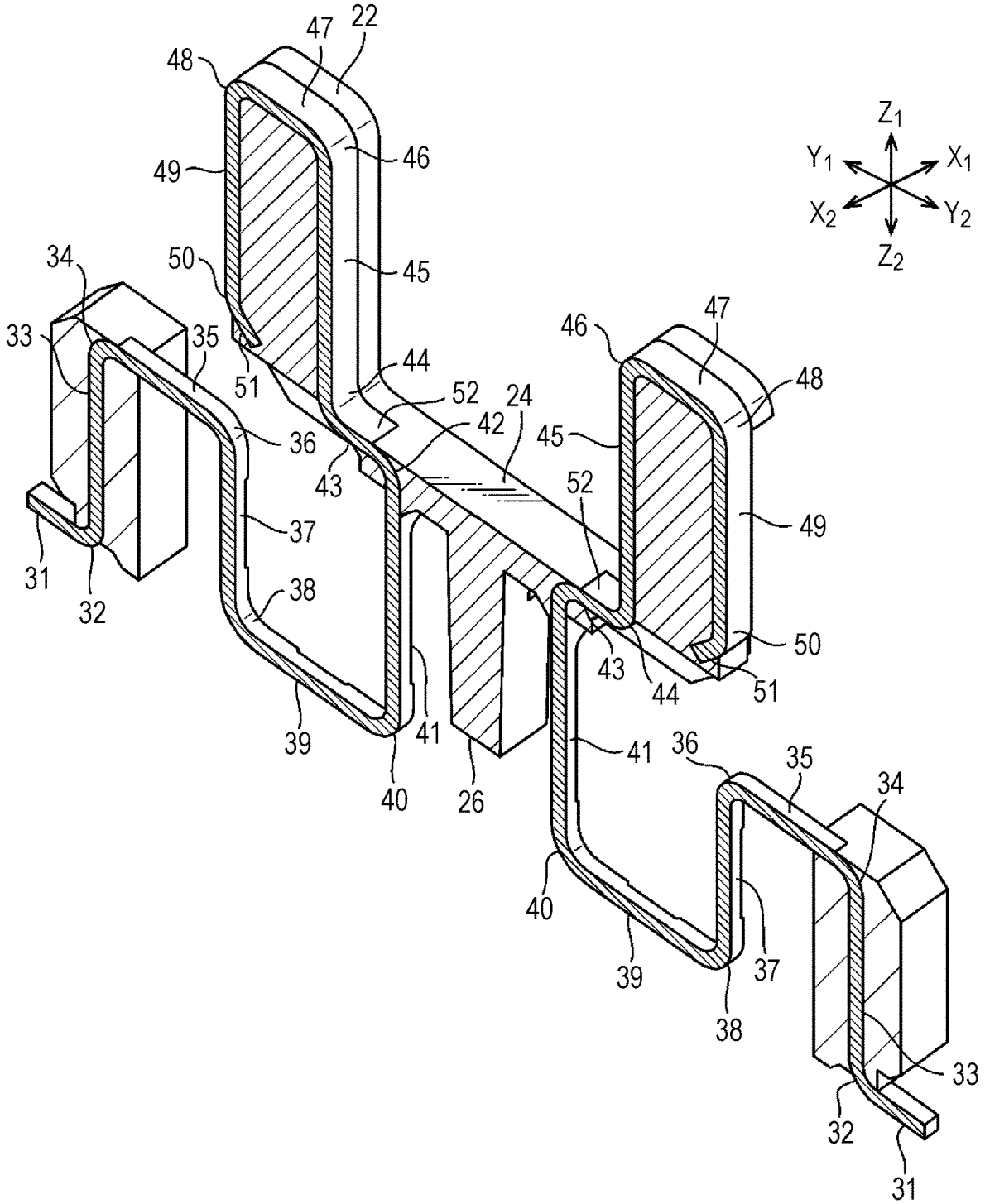
FIG. 7 is a partial cross-sectional perspective view taken along the line A-A of FIG. 2.
Figure 8:
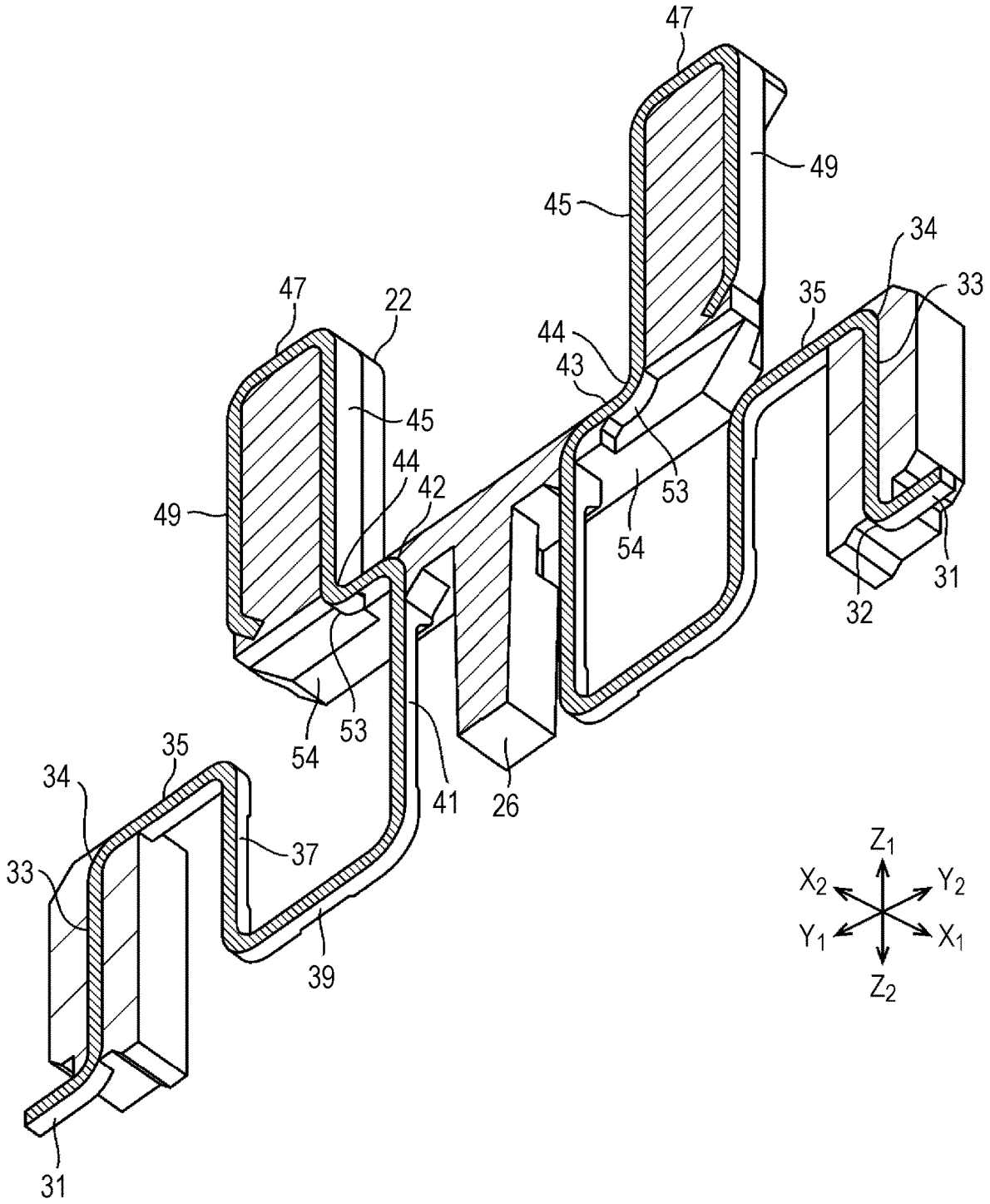
FIG. 8 is a partial cross-sectional perspective view taken along the line A-A of FIG. 2.
Figure 9:
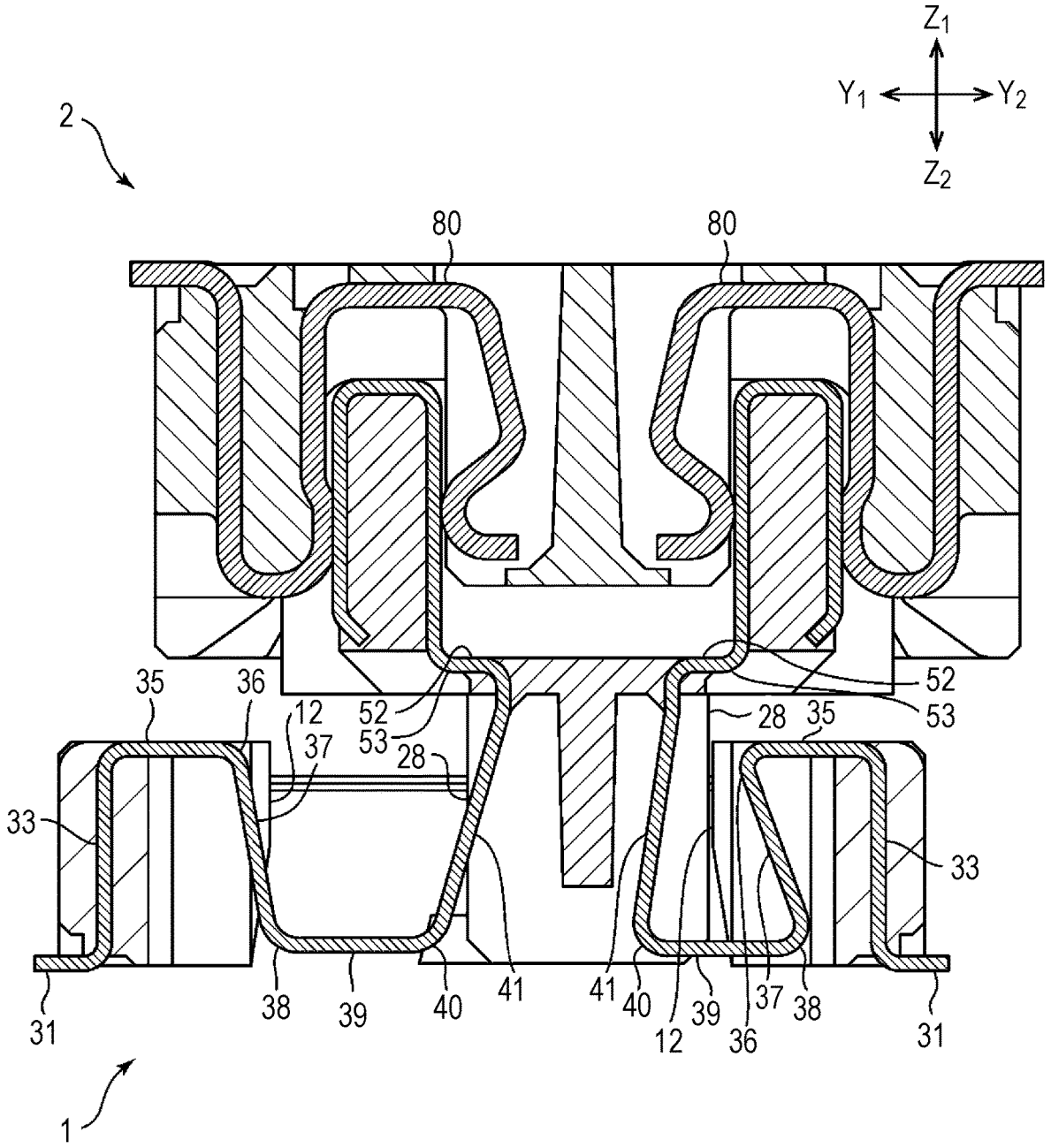
FIG. 9 is a cross-sectional view illustrating a floating state of the electrical connector according to the embodiment of the present disclosure and the mating connector when they are fitted together.

FIG. 1 is a perspective view illustrating a structure of the electrical connector and a mating connector according to an embodiment of the present disclosure. FIG. 2 is a front view illustrating the structure of the electrical connector and the mating connector according to the present embodiment. FIG. 3 is a cross-sectional view taken along a line A-A of FIG. 2. FIG. 4 is a plan view illustrating the structure of the electrical connector according to the present embodiment. FIG. 5 is a cross-sectional view taken along a line B-B of FIG. 4. FIG. 6 is a perspective view illustrating a structure of the terminal of the electrical connector according to the present embodiment. FIG. 7 is a partial cross-sectional perspective view taken along the line A-A of FIG. 2 (a view seen from above). FIG. 8 is a partial cross-sectional perspective view taken along the line A-A of FIG. 2 (a view seen from below). FIG. 9 is a cross-sectional view illustrating a floating state of the electrical connector according to the present embodiment and the mating connector when they are fitted together (corresponding to an A-A cutting surface of FIG. 2).

First, an example of a structure of an electrical connector 1 according to the present embodiment will be described with reference to FIG. 1. As illustrated in FIG. 1, the electrical connector 1 of the present embodiment is a plug connector mounted on a circuit board 3. The electrical connector 1 includes a fixed housing 10 fixed to the circuit board 3, a movable housing 20 separated from the fixed housing 10 and displaceable with respect to the fixed housing 10, a plurality of terminals 30 held by the fixed housing 10 and the movable housing 20, a pair of support fittings 60 held by the fixed housing 10. Even if misalignment (error) of the circuit board 3 or the housing occurs, the electrical connector 1 according to the present embodiment can absorb the misalignment in XYZ directions. That is, the electrical connector 1 is a so-called floating connector. That is, even if relative positions of connectors are shifted from each other, the terminals 30 are elastically deformed and the movable housing 20 is displaced in the XYZ directions, so that the connectors can be normally fitted to each other within a certain allowable range. The pair of support fittings 60 is configured to restrict displacement of the movable housing 20 in the Z direction.

As illustrated in FIG. 1, the mating connector 2 is a receptacle connector mounted on the circuit board 4. The mating connector 2 includes a housing 70, a plurality of terminals 80, and a pair of support fittings 90 held by the housing 70. When the electrical connector 1 and the mating connector 2 are fitted to each other, the corresponding terminals 30 and 80 are brought into contact with each other, and the terminals of both connectors are electrically connected.

In the present embodiment, the electrical connector 1 and the mating connector 2 are configured to be symmetrical in both the X direction and the Y direction. The electrical connector 1 and the mating connector 2 are configured to have 10 terminals each arranged to be opposed to another terminal, thus having 20 terminals in total. However, the number of terminals is not limited to this. Further, the fixed housing 10, the movable housing 20, and the housing 70 are made of an insulating material such as resin, plastic material, or carbon fiber. The terminals 30 and 80 are made of a conductive material such as metal. The support fittings 60 and 90 are made of a material that can be bent, such as metal. However, a component of the electrical connector 1 and the mating connector 2, and a material of the component thereof is not necessarily limited to this. For example, the support fittings 60 may be formed as a part of the fixed housing 10.

As illustrated in FIGS. 1 to 4, the fixed housing 10 of the electrical connector 1 has a pair of side wall portions 11 facing each other in the Y direction. The pair of side wall portions 11 extends in the X direction. Both end portions of the pair of side wall portions 11 are connected by the pair of support fittings 60. The pair of side wall portions 11 and the pair of support fittings 60 form a rectangular shape of the fixed housing 10. The fixed housing 10 has an opening inside the rectangular shape. The fixed housing 10 holds first fixing portions (32 to 34, and a part of 35) of the terminals 30. A board connecting portion 31 of the terminal 30 and a board connecting portion 61 of the support fitting 60 are exposed from below (a $Z_2$ side of) the fixed housing 10. The board connecting portion 31 and the board connecting portion 61 is soldered to the circuit board 3, so that the fixed housing 10 is fixed to the circuit board 3.

As illustrated in FIGS. 1 to 5, the movable housing 20 has a fitting recess 21 protruding above (to a $Z_1$ side of) the fixed housing 10. The movable housing 20 is configured such that a fitting protrusion 71 of the mating connector 2 is fitted into the fitting recess 21 when the connector is fitted. The fitting recess 21 includes a pair of side wall portions 22 facing each other in the Y direction, a pair of connecting wall portions 23 connecting both end portions of the pair of side wall portions 22, and a bottom wall portion 24 connecting the pair of side wall portions 22 and the pair of connecting wall portions 23. The pair of side wall portions 22 extends in the X direction. The pair of connecting wall portions 23 extends in the Y direction. The bottom wall portion 24 extends in the XY directions at bottom portions of the side wall portions 22 and the connecting wall portions 23. The movable housing 20 holds the second fixing portions (42 to 51) of the terminals 30. The terminals 30 are exposed along both side surfaces and an upper surface of the side wall portion 22. In the bottom wall portion 24, a thick portion 54 is formed at a position between the terminals in an arrangement direction of the terminals 30 (the X direction), and in lower portions (in the $Z_2$ direction) of the pair of side wall portions 22. The thick portion 54 increases strength of the movable housing 20 and improves retention of the terminals 30 by the second fixing portions (42 to 51).

The movable housing 20 further includes a pair of restricting protrusions 25 protruding to both sides in the X direction below the bottom wall portion 24, and a connecting protrusion 26 connecting the pair of restricting protrusions 25. The restricting protrusion 25 restricts a movement range of the movable housing 20 with respect to the fixed housing 10. A part of the restricting protrusion 25 is located below (in the $Z_2$ direction of) the support fitting 60 and between the pair of side wall portions 11 of the fixed housing 10. The connecting protrusion 26 reinforces the strength of the movable housing 20. The connecting protrusion 26 extends in the X direction. Further, a width (length in the Y direction) of the connecting protrusion 26 is less than that of the restricting protrusion 25 so as not to hinder elastic deformation of the terminal 30.

An inner side surface 62 of the support fitting 60 comes into contact with an outer side surface 27 of the connecting wall portion 23 of the movable housing 20, so that the movement range in the X direction is restricted. Further, an inner side surface 12 of the side wall portion 11 of the fixed housing 10 comes into contact with a side surface 28 of the restricting protrusion 25 of the movable housing 20, so that the movement range in the Y direction is restricted. Furthermore, a bottom surface 63 of the support fitting 60 and a surface (mounting surface) of the circuit board 3 respectively come into contact with an upper surface 29 and a lower surface 55 of the restricting protrusion 25 of the movable housing 20, so that the movement range in the Z direction is restricted.

As illustrated in FIGS. 1 to 6, the terminals 30 have the same shape. The terminals 30 are arranged in two rows in the X direction along the side wall portion 22 of the movable housing 20 and the side wall portion 11 of the fixed housing 10. The terminals 30 facing each other in the two rows are arranged symmetrically in the Y direction.

As illustrated in FIG. 6, each of the terminals 30 includes the board connecting portion 31 to be soldered to the circuit board 3, a linear shaped portion 33 extending in a fitting direction (the Z direction), a bent portion 32 connecting the board connecting portion 31 and the linear shaped portion 33, a linear shaped portion 35 (fifth linear shaped portion) extending in a direction (the Y direction) perpendicular to the fitting direction (Z direction), a bent portion 34 connecting the linear shaped portion 33 and the linear shaped portion 35, a linear shaped portion 37 (sixth linear shaped portion) extending in the Z direction, a bent portion 36 (fifth bent portion) connecting the linear shaped portion 35 and the linear shaped portion 37, a linear shaped portion 39 (seventh linear shaped portion) extending in the Y direction, a bent portion 38 (sixth bent portion) connecting the linear shaped portion 37 and the linear shaped portion 39, a linear shaped portion 41 (eighth linear shaped portion) extending in the Z direction, a bent portion 40 (seventh bent portion) connecting the linear shaped portion 39 and the linear shaped portion 41, a linear shaped portion 43 (the first linear shaped portion) extending in the Y direction, a bent portion 42 connecting the linear shaped portion 41 and the linear shaped portion 43, a linear shaped portion 45 (second linear shaped portion) extending in the Z direction, a bent portion 44 (first bent portion) connecting the linear shaped portion 43 and the linear shaped portion 45, a linear shaped portion 47 (third linear shaped portion) extending in the Y direction, a bent portion 46 (second bent portion) connecting the linear shaped portion 45 and the linear shaped portion 47, a linear shaped portion 49 (fourth linear shaped portion) extending in the Z direction, a bent portion 48 (third bent portion) connecting the linear shaped portion 47 and the linear shaped portion 49, an embedded portion 51 embedded in the side wall portion 22, and a bent portion 50 (fourth bent portion) connecting the linear shaped portion 49 and the embedded portion 51.

The terminal 30 mainly includes the board connecting portion 31 connected to the circuit board 3, the first fixing portion (32 to 34, and a part of 35) held by the fixed housing 10, the second fixing portion (42 to 51) held by the movable housing 20, and an elastically deformable elastic portion (a part of 35, and 36 to 41) between the first fixing portion and the second fixing portion. A portion that contributes to floating function is the elastic portion (a part of 35, and 36 to 41). The first fixing portion (32 to 34, and a part of 35) and the second fixing portion (42 to 51) do not contribute to the floating function. The linear shaped portions 45 and 49 are portions that come into contact with the terminal 80 of the mating connector 2 to be electrically connected, when the connector is fitted. The width of the elastic portion (a part of 35, and 36 to 41) is less than that of the second fixing portion (42 to 51). The width near the center of the linear shaped portions 37, 39 and 41 out of the elastic portion is further reduced. Thus, the elastic portion is easily deformed to increase elasticity. Further, a step is provided near the center of the linear shaped portion 33 out of the first fixing portion. Thus, the terminal 30 is difficult to come off from the fixed housing 10.

FIG. 7 is the partial cross-sectional perspective view taken along the line A-A of FIG. 2 (the view seen from above). FIG. 8 is the partial cross-sectional perspective view taken along the line A-A of FIG. 2 (the view seen from below). In FIGS. 7 and 8, the terminal 30 is cut at the center and is illustrated with a half width. As illustrated in FIGS. 7 and 8, in the second fixing portion (42 to 51), the bent portion 44, the linear shaped portion 45, the bent portion 46, the linear shaped portion 47, the bent portion 48, the linear shaped portion 49, and the bent portion 50 extend along the surface of the side wall portion 22 of the movable housing 20. A free end of the terminal 30 is embedded in the side wall portion 22 to form the embedded portion 51.

The bent portion 42 is embedded in the bottom wall portion 24 of the movable housing 20. At least a part of the linear shaped portion 43 (first linear shaped portion) is exposed from the surface of the bottom wall portion 24, to form a linear exposed portion 52. That is, the linear exposed portion 52 is exposed to the fitting recess 21 and is visible when the electrical connector 1 is seen in the Z direction (see FIG. 4). Further, the bent portion 44 is exposed from the surface of the side wall portion 22 and the surface of the bottom wall portion 24. A portion of the opposite surface ($Z_2$ direction) is also exposed from the outer surface of the bottom wall portion 24, to form a curved exposed portion 53. That is, the curved exposed portion 53 is visible when the electrical connector 1 is seen in the Y direction (see FIG. 2). As described above, by providing the linear exposed portion 52 and the curved exposed portion 53 exposed from the bottom wall portion 24 or the side wall portion 22 of the movable housing 20, the linear exposed portion 52 and the curved exposed portion 53 can be brought into contact with the mold when the movable housing 20 is molded by integral molding (insert molding) with the terminal 30. Then, the terminal 30 can be favorably fixed with the mold. Therefore, since the misalignment of the terminal 30 due to injection molding is suppressed, the positional accuracy in the integral molding is improved. That is, by bringing the mold into contact with the linear exposed portion 52, the misalignment of the terminal 30 in the Z direction can be favorably restricted. Further, by bringing the mold into contact with the curved exposed portion 53, the misalignment of the terminal 30 in the Z direction and the Y direction can be favorably restricted.

The linear shaped portion 47 is exposed from the surface of the side wall portion 22 and is visible when the electrical connector 1 is seen in the Z direction (see FIG. 4). In this way, by providing the linear shaped portion 47 exposed from the surface of the side wall portion 22, the linear shaped portion 47 can be brought into contact with the mold when the movable housing 20 is molded by integral molding (insert molding) with the terminal 30. Then, the terminal 30 can be favorably fixed with the mold. Therefore, since the misalignment of the terminal 30 due to injection molding is suppressed, the positional accuracy in the integral molding is improved. By bringing the mold into contact with two positions of the linear exposed portion 52 and the linear shaped portion 47, the misalignment of the terminal 30 in the Z direction can be favorably restricted.

Similarly, the linear shaped portion 45 and the linear shaped portion 49 are exposed from the surface of the side wall portion 22 and are visible when the electrical connector 1 is seen in the Y direction (see FIG. 2). In this way, by providing the linear shaped portion 45 and the linear shaped portion 49 exposed from the surface of the side wall portion 22, the linear shaped portion 45 and the linear shaped portion 49 can be brought into contact with the mold when the movable housing 20 is molded by integral molding (insert molding) with the terminal 30. Then, the terminal 30 can be favorably fixed with the mold. Therefore, since the misalignment of the terminal 30 due to injection molding is suppressed, the positional accuracy in the integral molding is improved. By bringing the mold into contact with two positions of the linear shaped portion 45 and the linear shaped portion 49, the misalignment of the terminal 30 in the Y direction can be favorably restricted.

Next, the floating function of the electrical connector 1 according to the present embodiment will be described with reference to FIG. 9. In the electrical connector 1 according to the present embodiment, the movable housing 20 can move in the XYZ directions with respect to the fixed housing 10 within a certain range. Thus, the misalignment from the mating connector 2 can be absorbed. FIG. 9 illustrates a cross-section of the electrical connector 1 according to the present embodiment and the mating connector 2 when they are fitted together. FIG. 9 illustrates a shape of the terminal 30 when the mating connector 2 is shifted from the electrical connector 1 in the Y2 direction. In this case, as illustrated in FIG. 9, the bent portion 36, the linear shaped portion 37, the bent portion 38, the linear shaped portion 39, the bent portion 40, and the linear shaped portion 41 of the elastic portion of the terminal 30 are deformed, so that the misalignment between the connectors is absorbed. Further, since the elastic portion has three bent portions, it is easily elastically deformed. Regarding a movable range in the Y direction, the inner side surface 12 of the side wall portion 11 of the fixed housing 10 comes into contact with the side surface 28 of the restricting protrusion 25 of the movable housing 20, so that the movement in the Y direction is restricted.

Next, a method for manufacturing the electrical connector 1 according to the present embodiment will be described. The pair of support fittings 60 and the terminals 30 are manufactured by punching and bending a single metal plate. In this state, the pair of support fittings 60 and the terminals 30 are coupled to each other via carriers and have a predetermined positional relationship. The carrier of the support fitting 60 is provided to extend in the Y direction from an end of the board connecting portion 61. The carrier of the terminal 30 is provided to extend in the Y direction from an end of the board connecting portion 31. That is, the fixed housing 10 side of the terminal 30 is not directly fixed by the carrier. Next, the mold is set on the pair of support fittings 60, the terminals 30, and the carriers, which are integrated. At this time, the terminal 30 is positioned so that at least the linear exposed portion 52 and the curved exposed portion 53 contact the mold. The positioning may be performed such that only the linear exposed portion 52 or the curved exposed portion 53 contacts the mold. Next, a resin or the like is injected into the mold and the injection molding is performed. Thus, the fixed housing 10 and the movable housing 20 are molded. Thereafter, the mold is removed, and the pair of support fittings 60 and the ends of the terminals 30 are cut from the carriers.

Therefore, according to the electrical connector 1 and the method for manufacturing the same according to the present embodiment, a part of the terminal 30 is exposed from the fixed housing 10. Therefore, at the time of integral molding, the positional accuracy of the terminals 30 is improved by bringing the mold into contact with their exposed portions to align the terminals 30.

The technology developed by the present inventors has been specifically described above based on the embodiments. However, it goes without saying that the technology of the present disclosure is not limited to the above embodiments and can be variously modified without departing from the gist thereof.

For example, in the above embodiments, a case where the plug connector has the floating function has been described. Alternatively or additionally, the receptacle connector may have the floating function.

In the above embodiments, a case where the technique of the present disclosure is applied to the plug connector mounted on the circuit board has been described. The technique of the present disclosure is not limited to the plug connector, but may be applied to a connector connected to a cable or the like.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An electrical connector comprising:

a fixed housing;

a movable housing displaceable with respect to the fixed housing;

a plurality of terminals held by the fixed housing and the movable housing;

wherein the terminal has a board connecting portion connected to a circuit board, a first fixing portion held by the fixed housing, a second fixing portion held by the movable housing, and an elastic portion between the first fixing portion and the second fixing portion, the movable housing has a fitting recess into which a fitting protrusion of a mating connector is fitted, the fitting recess has a pair of side wall portions facing each other, a pair of connecting wall portions connecting both end portions of the pair of side wall portions, and a bottom wall portion connecting the pair of side wall portions and the pair of connecting wall portions, the plurality of terminals is held by the pair of side wall portions and the bottom wall portion, the second fixing portion of the terminal has a first linear shaped portion extending along an inner surface of the bottom wall portion, a second linear shaped portion extending along an inner side surface of the side wall portion, and a first bent portion connecting the first linear shaped portion and the second linear shaped portion, and at least a part of the first linear shaped portion is exposed from the movable housing on an inner wall surface of the bottom wall portion.

2. The electrical connector according to claim 1, wherein at least a part of the first bent portion of the terminal is exposed from the movable housing on an outer bottom surface of the bottom wall portion.

3. The electrical connector according to claim 1, wherein the second fixing portion of the terminal has a third linear shaped portion extending along an upper surface of the side wall portion, a second bent portion connecting the second linear shaped portion and the third linear shaped portion, a fourth linear shaped portion extending along an outer side surface of the side wall portion, a third bent portion connecting the third linear shaped portion and the fourth linear shaped portion, an embedded portion embedded in an outer wall portion of the side wall portion, and a fourth bent portion connecting the fourth linear shaped portion and the embedded portion, and the first bent portion, the second linear shaped portion, the second bent portion, the third linear shaped portion, the third bent portion, and the fourth linear shaped portion are exposed from the movable housing.

4. The electrical connector according to claim 3, wherein the elastic portion of the terminal has a fifth linear shaped portion extending from the first fixing portion, a sixth linear shaped portion extending in a direction perpendicular to the fifth linear shaped portion, a fifth bent portion connecting the fifth linear shaped portion and the sixth linear shaped portion, a seventh linear shaped portion extending in a direction perpendicular to the sixth linear shaped portion, a sixth bent portion connecting the sixth linear shaped portion and the seventh linear shaped portion, an eighth linear shaped portion extending from the second fixing portion, and a seventh bent portion connecting the seventh linear shaped portion and the eighth linear shaped portion.

5. The electrical connector according to claim 1, further comprising a pair of support fittings held by the fixed housing, wherein the pair of support fittings is configured to restrict displacement of the movable housing.

6. The electrical connector according to claim 1, wherein at least a part of the elastic portion of the terminal has a width less than that of the second fixing portion.

7. The electrical connector according to claim 1, wherein the terminal is manufactured by punching and bending a metal plate.

8. A method for manufacturing the electrical connector according to claim 1, comprising a step of integrally molding the fixed housing, the movable housing, and the terminal in a state where at least a part of the first linear shaped portion of the terminal is in contact with a mold.

9. The method for manufacturing the electrical connector according to claim 8, wherein in the step of integrally molding the fixed housing, the movable housing, and the terminal, they are integrally molded in a state where at least a part of the first bent portion of the terminal is in contact with the mold.

* * * * *